United States Patent [19]

Neir

[11] Patent Number: 4,923,188

[45] Date of Patent: May 8, 1990

[54] Z-FOLD PAPER SHEET CARRIER

[75] Inventor: Kenneth E. Neir, San Jose, Calif.

[73] Assignee: Spectra-Physics, San Jose, Calif.

[21] Appl. No.: 262,924

[22] Filed: Oct. 26, 1988

[51] Int. Cl.[5] ..... B65M 45/00

[52] U.S. Cl. ..... 270/39; 493/410; 400/613.2; 271/3

[58] Field of Search ..... 270/30, 39–40, 270/52, 52.5; 493/410–413, 417, 409, 458; 400/613.2, 613, 613.1; 271/3

[56] References Cited

U.S. PATENT DOCUMENTS

| | | | |
|---|---|---|---|
| 2,061,595 | 11/1936 | Sherman | 400/613.2 |
| 2,845,019 | 7/1958 | Stiefel | 400/613.2 |
| 3,712,607 | 1/1973 | Ziegler | 270/39 |
| 4,530,689 | 7/1985 | Ringer | 400/613.2 |
| 4,743,131 | 5/1988 | Atwell | 400/613.2 |

FOREIGN PATENT DOCUMENTS

| | | | |
|---|---|---|---|
| 3531420 | 3/1987 | Fed. Rep. of Germany | 400/613.2 |
| 60-0061278 | 4/1985 | Japan | 400/613.2 |
| 2176770A | 1/1987 | United Kingdom | 270/39 |

OTHER PUBLICATIONS

"Fan-Fold Paper Rack", David, IBM Technical Bulletin, vol. 4, No. 1, Jun. 1961.

*Primary Examiner*—Robert E. Garrett
*Assistant Examiner*—Therese M. Newholm
*Attorney, Agent, or Firm*—Skjerven, Morrill & MacPherson

[57] ABSTRACT

A Z-fold computer paper sheets unfolding/refolding carrier includes a horizontal base, a forward portion of which underlies a computer or printer housing. A supply of folded computer paper sheets is held by a first lower trough between upstanding rod stock open frame members adjacent the carrier base. A second upper trough is connected across the frame members about and forwardly of the first trough so that the second trough will overlie the rear of the computer or printer housing and be positioned to refold printed-on paper sheets exiting from the printer or computer housing. A guide ramps clips on the extends from a front top edge of the upper trough and is pivotable into a position to bridge the gap between the printer paper exit and the upper trough so as to guide the exiting paper to be refolded automatically in the upper trough. All parts other than the ramp are preferably constructed of rod stock.

19 Claims, 3 Drawing Sheets

Z-FOLD PAPER SHEET CARRIER

RELATED APPLICATION

A Design application Ser. No. 07/264250 filed 10-26-88 is being filed herewith.

FIELD OF THE INVENTION

This invention is directed to a Z-fold computer paper carrier for storing a stack of folded continuous paper sheets which are fed into a printer mechanism and for refolding printed-on sheets of that stack which have exited the printer mechanism. More particularly, the invention is directed to a free-standing Z-fold paper sheets carrier with tiered paper stack-holding troughs.

BACKGROUND OF THE INVENTION

Multi-folded and edge perforated stacks of computer paper are extensively used in stand-alone computer printers and in computers which have an integrated printing/plotting mechanism. In many cases, folded paper sheets are fed direct from the paperboard box containing the Z-fold sheets or provision is made on the printer itself to hold a stack of continuous multi-folded edge perforated sheets of computer paper in a suitable rack. The type of stack is generally known interchangeably as Z-fold or fan-folded paper. The term Z-fold will be used herein to describe the type of paper stack which is carried by and refolded by the carrier of the invention. In many operations, printed-on paper is not refolded automatically but rather just exits from the rear of the printer and falls to an adjacent floor or to the rear of the printer and the operator/user must then pick-up and manually refold the whole stack or separate portions of the continuous stack into several smaller refolded stacks for subsequent use or storage. Several printer stands have been suggested and commercially sold which include an acrylic plastic folded paper storage box placed on a work surface on top of which a printer rests and a separate acrylic plastic open catch basket resting on the same work surface for refolding the finished print out; a vinyl-coated wire box under the printer with an end-attached vinyl-coated wire catch basket extending therefrom; a double-tiered vinyl-coated wire box under the printer with stored unused continuous Z-fold paper sheets in a slanted top shelf and a bottom shelf for receiving refolded sheets exiting the printer; and caster-movable floor units with or without shelves for feeding and refolding Z-fold computer paper.

Each of the above prior art carriers or systems take up as much again or more than the space dedicated to the printer housing itself or are stacked below the printer thus raising the printer in elevation above its normal workstation level. It is desirable that the level of the printer and especially a printer incorporated in a keyboard-containing computer or integrator not be placed at a higher level than the normal level for the human user. Further, it is desired to minimize the footprint of the carrier and to make the carrier of a minimal length so that it can fit behind a printer without interference with a work surface back wall which may be as little as two feet from the front edge of the worksurface. The carrier should also be easily movable to provide easy access for connection and disconnection of input and output cables to the printer/computer. Additionally it is highly desirous that the printed-on paper continues to be visible for reading by the user as it is exiting the printing mechanism, as it is being refolded and after it has been refolded and again stacked. Further, it is advantageous to have a construction in which an operator/user can easily manually place identifying comments or indicia on the printed data as it exits the printing mechanism and before it is fully refolded without creasing, wrinkling or tearing the continuous paper sheets. Lastly a device which allows reversal of the unfolding/refolding action is advantageous in that it allows the refolded sheets themselves to be conveyed back into the printer mechanism exit and after refolding into the normally unprinted folded sheets holder, which are then passed a second time through the printer mechanism to perform a reprint or additional print operation (e.g. an additional color presentation) on those sheets. The reprinted sheets are again refolded as they reach the refolding upper trough.

SUMMARY OF THE INVENTION

The invention described herein provides a free-standing paper carrier for unfolding and refolding connected sheets of a continuous stack of Z-folded computer paper. The cover is positionable at the rear of a printer housing or a computer housing having its own dedicated printer mechanism, such as a computer integrator used in chromatographic analysis systems. A pair of horizontally displaced tiered open troughs typically made of rod stock are provided extending across an open rod stock support frame, the lower trough being attached adjacent a rod stock carrier base which sits on the same normally flat horizontal work surface as the printer/computer to be paper fed. The upper trough extends forwardly and above the lower trough and above the plane of the printer mechanism paper exit for reception of the printed-on paper to be refolded and stacked therein. A pivotable flat paper guide ramp is provided at a top front edge of the upper trough which bridges the gap between the upper trough and the paper exit from the printer mechanism to aid in the movement of the paper sheets to the refolding upper trough. The ramp also provides a writing surface for the operator to manually make pencil or ink notes or other indicia on the printer exiting paper. The paper exiting the printer mechanism and the printed-on sheets being refolded and stacked in the upper trough may be easily read by the operator while he or she sits at the computer keyboard. The invention also contemplates that the troughs and frames of the carrier be constructed from injection molded or otherwise formed plastic or other sheet material.

Due to the particular angles of construction and relationship of the troughs, the Z-fold paper is unfolded from the lower trough and conveyed into the printer mechanism and subsequently the print-out is conveyed into and refolded for stacking in the upper trough. The paper carrier of the invention necessitates only about a six-inch (288 mm) clearance between the rear of the printer/computer housing and the back wall or end of the work bench or table forming the work surface. Part of the carrier base is slid under and therefore extends under the printer/computer housing and part of the upper trough and essentially all of the ramp extends above rear sections of the printer/computer housing. The paper carrier when empty can be easily removed or angularly moved or slightly shifted behind the printer/computer housing so as to provide for cable connection or disconnection. Room is also provided so that the printer/computer cables can be placed without interference between the rear of the printer/computer housing and a front section of the lower trough immediately above the base. The invention also permits the reversal of the refolded sheets operation so that the refolded sheets in the upper trough are unfolded by a reversal of the printer paper drive mechanism so that the then unfolded paper sheets pass into the printer mechanism exit and back to the lower trough where they are refolded. Upon the desired number of sheets being reversed the printer paper drive mechanism is placed into normal drive operation and passes the reversed sheets back through the printer mechanism for a reprint operation and the double-printed sheets are then refolded into the upper trough.

DETAILED DESCRIPTION

Figure 1:
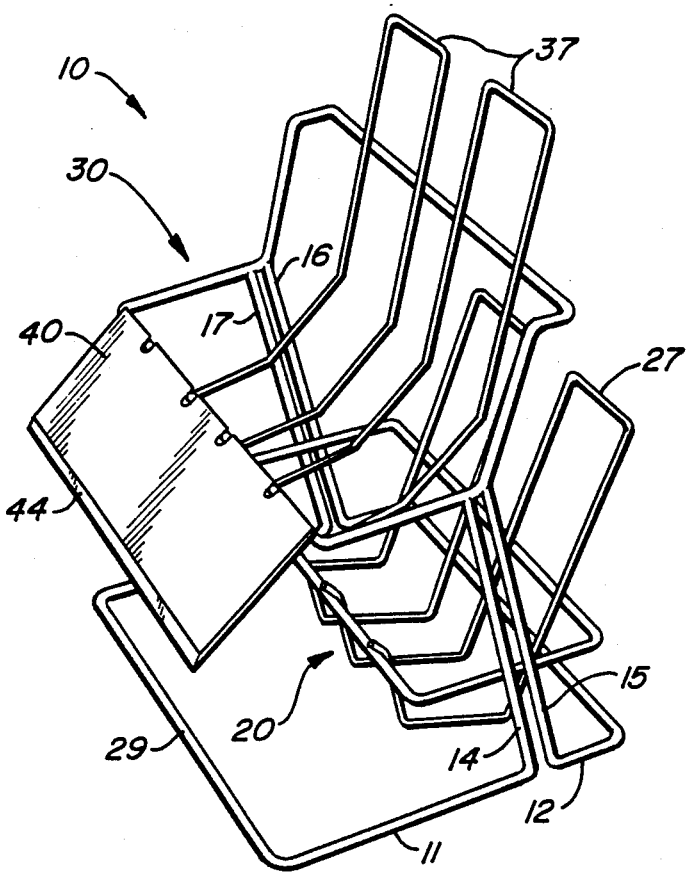
FIG. 1 is a prospective view of the preferred embodiment of the paper carrier.
Figure 2:
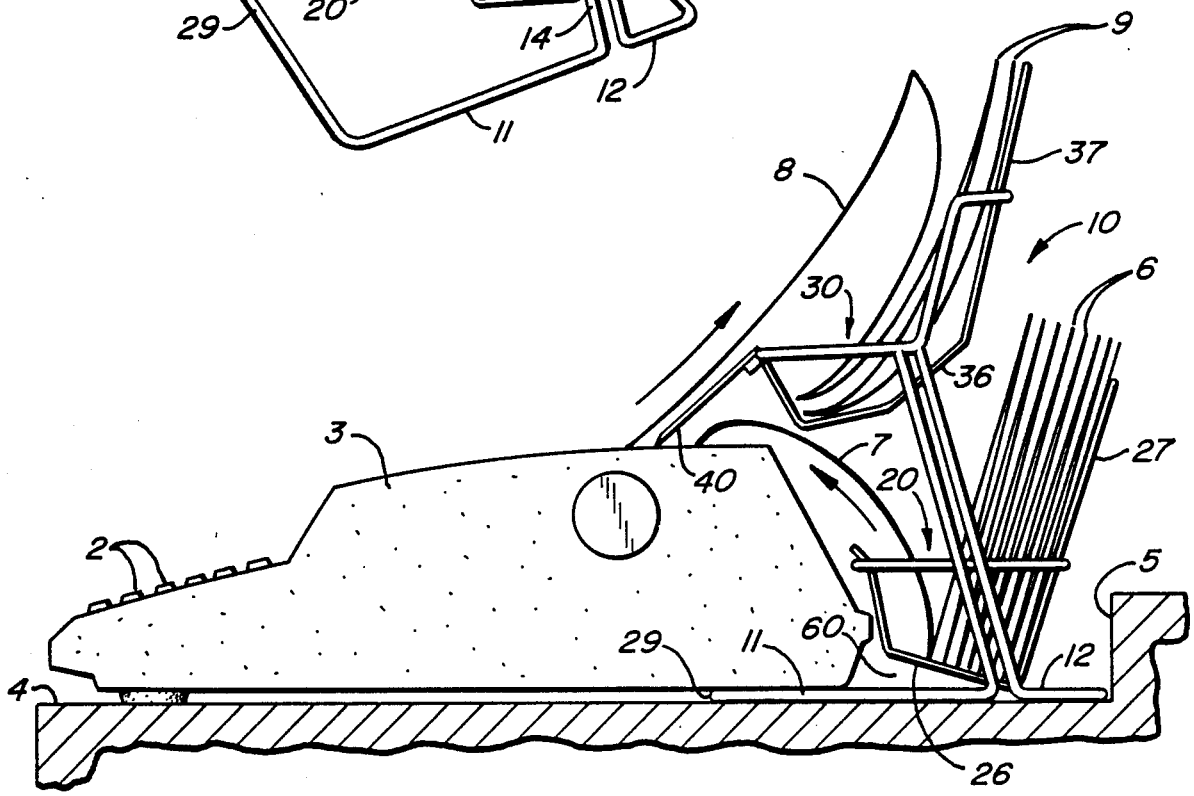
FIG. 2 is a side view of the paper carrier of FIG. 1 in operating position with paper sheets being fed to a computer integrator including a printing mechanism.
Figure 3:
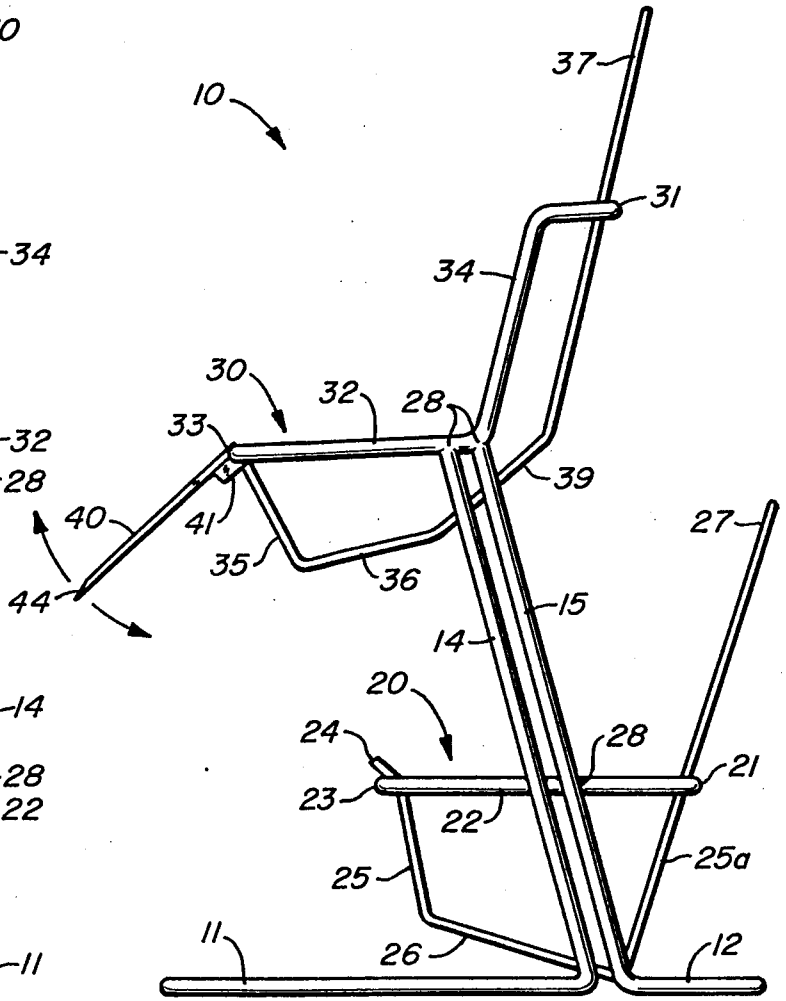
FIG. 3 is a side view of the paper carrier.

In FIG. 1 the paper carrier 10 includes a free-standing base made up of a forward facing U-shaped rod stock portion 11 having a forward bent end 29 and a rearward facing U-shaped rod stock portion 12. The rod stock members may be thin steel rods nickel-plated for both appearance and corrosion resistance. A double pair of integral rod-stock frame members 14, 15 and 16, 17 extend upwardly from the respective U-shaped base portions angularly and forwardly. A first open rod stock lower trough 20 is connected across the upstanding frame members adjacent the base portions 11 and 12. The trough 20 as seen in FIG. 3 has a rear horizontal edge 21, side edges 22 welded as at 28 to the frame members, a front edge 23 and a series of transverse basket-like bent rod members including a front section 25, a paper-supporting bottom section 26, a rear section 25*a*, and a pair of U-shaped paper stack rod stock supports 27 for supporting a folded stack of Z-fold computer paper sheets (FIG. 2). As shown, each of these bent rod members are of a smaller diameter, for example $\frac{1}{8}$ inch, than the rod stock of the base, frame members and the top edges of the troughs, which typically have a diameter of 7/32 inch. A series of cantilevered rod stock stubs or extensions 24 extend at an acute angle from front edge 23 for supporting paper sheets exiting the first lower trough.

A second open upper rod stock trough 30 is connected between the outer frame members 14, 15 and 16, 17 at a position forward of and spaced above the lower trough 20. Trough 30 has (FIG. 3) a horizontal rearward refolded paper-holding cross-member 31, side members 32 welded to the frame members 14, 15, a front edge 33 between the side members, a pair of L-shaped members formed by the side members 32 and upward extensions 34 leading to the cross-member 31. The basket portions of the upper trough are formed by bent front rod stock members 35, bottom members 36 and rear members 39. The L-shaped members prevent lateral movement of the refolded paper sheets and act as an arm forwardly of the plane in which the bottommost refolded sheets are stacked in trough 30 against the rear rod stock member 39 of the trough and upstanding U-shaped trough stack supports 37 extending from cross-member 31.

The forward bent edge 29 of base 11 extends forwardly of both troughs 20 and 30 to give stability to the base and to provide a portion which is extendable under the rear bottom edge of a printer or computer housing (FIG. 2). Extending from the top front edge 33 of the upper trough is a guide ramp 40 pivotable thereon for bridging a gap between the paper exit on the printer mechanism and the front top edge of the upper trough. The reverse side of the ramp (FIGS. 5–6) has a series of, typically three, L-shaped mounting clips, either screw-mounted or integral with the ramp for interference fit clip-on with the upper trough front top edge 33. An edge bevel 44 (FIG. 6) is provided on the obverse side of the ramp to aid in guiding the paper from the printer paper exit to the upper trough. The ramp may be made of transparent Lexan polycarbonate plastic slightly wider, e.g. $9\frac{3}{4}$ inch wide, than the $9\frac{1}{2}$ inch standard width of one size of Z-fold paper including its removable side perforations which interact with the printer paper drive mechanism. The ramp typically about $\frac{1}{8}$ inch thick has a top flat obverse surface about 3 inches wide adjacent bevel 44 which permits a user to manually write notes or place indicia on the paper print-out exiting from the printer paper exit. The top front edge 33 of the upper trough is typically about $1\frac{3}{4}$ inches above the feed and exit plane which thus permits reverse operation of the printer and the unfolding/refolding carrier. The particular size of carrier and its components is dependent on the size and number of computer paper sheets and the particular type of printer(s) or apparatus including a printer mechanism which is to be fed from the folded sheets stack.

FIG. 2 illustrates the invention in actual use with a computer terminal 3 having a keyboard 2 positioned on a horizontal work surface 4 having a back vertical wall 5. The paper sheets carrier 10 is positioned between the rear of computer or printer housing and the back wall 5 in a space as little as six inches wide. The bent end 29 of base portion 11 is slidable under the rear of computer toward the front keyboard in an amount so that the upper trough 30 and particularly the pivoted ramp 40 extend over the top rear of the computer housing. The lower front edge of trough 30 has a clearance of about $\frac{1}{4}$ inch from the computer/printer housing. The ramp is then pivoted to a position juxtaposed to the printer paper exit.

A stack 6 of Z-folded computer paper such as 500 sheets is placed in lower trough 20 and the first sheet 7 fed as shown by the arrow into the printer mechanism (not shown). After printing the printed-on sheet 8 (the printout) exits the printer as shown by the arrow where it passes over and parallel to the pivoted ramp 40 and is automatically refolded as it is pushed by the printer paper drive mechanism (not shown) into the upper trough 30 to form a refolded paper sheets stack 9. The sheet 8 can be pushed against ramp 40 and indicia written on the sheet on-the-run without interfering with the overall flow of paper sheets into and out of the printer mechanism.

The respective stacks 6 and 9 are held at a rearward angle of about 15° by the support function of angular stack supports 27 and 37. Lower trough 20 is configured to form a transverse channel 60 rearward of the computer housing suitable for conveying cables (not shown) for connection to sockets at the rear of the computer or printer housing and above base 29 and the work surface 4. Trough bottoms 26, 36 have an upward slope of about 5° to 15°, directed forwardly and rearwardly, respectively, to aid the unfolding and refolding of the paper sheets and to prevent buckling of the stack. The trough bottoms may be curved but the preferred embodiment construction includes bottom angular sections which result in less frictional slide surfaces and provide a carrier in which both the folded supply sheets in trough 20 and the refolded printout sheets in trough 30 essentially are in a laid back vertical position resting at about a 7° to 15° rearward angle from the vertical against the stack support 27, 37. This essentially vertical stack orientation allows the foreshortening of the overall carrier and the resultant small footprint of the carrier.

The upper trough is sized to accommodate about 150 refolded paper sheets since it is rare that a computer printer run is more than about 100 sheets before the user tears off a desired number of pages of print-out and removes the stack from the upper trough. In the case of chromatographic usages such as in the chemical, environmental research and monitoring, and process control fields, this covers a normal unattended chromatograph run.

Figure 4:
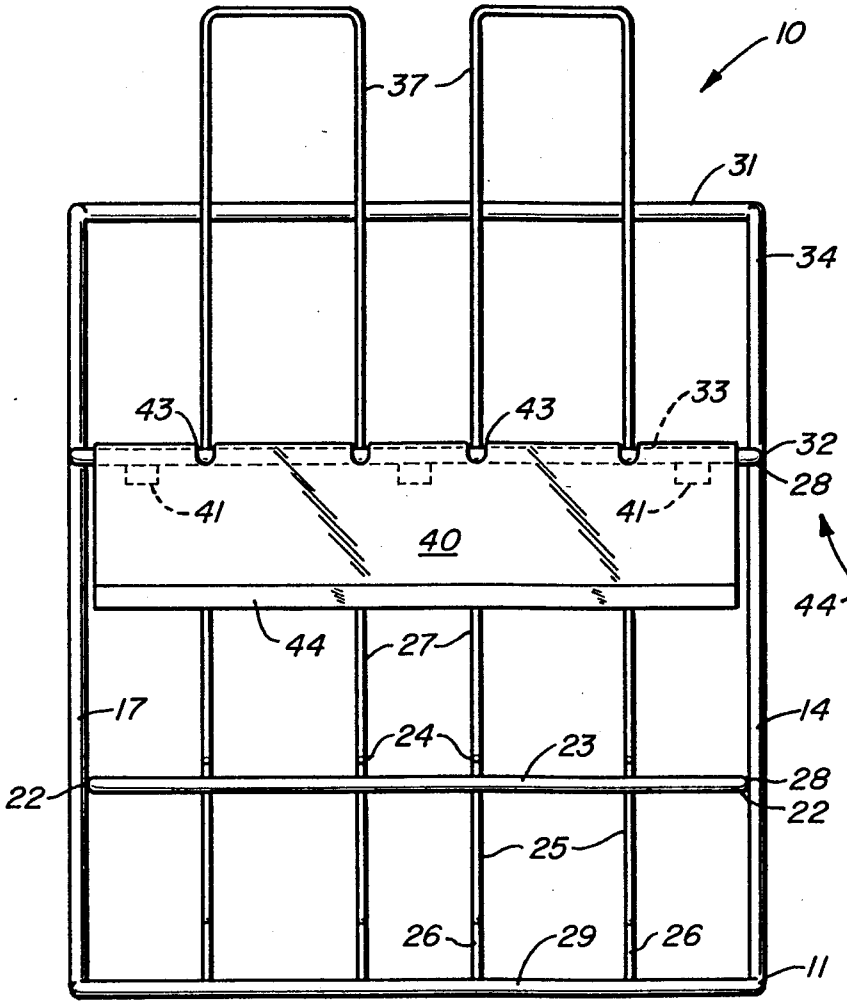
FIG. 4 is a front view of the paper carrier.

FIGS. 3 and 4 illustrate in detail the carrier base, the frame members and the lower and upper troughs. The angularity of each bent portion of this preferred embodiment are to scale and have the same reference numerals as those in FIG. 1. Particularly shown in FIG. 4 is the clip-on ramp 40 with clips 41 pivotably mounted on upper trough front upper edge 33.

Figure 5:
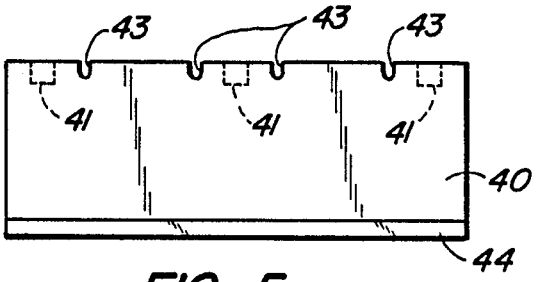
FIG. 5 is a top view of the guide ramp.
Figure 6:
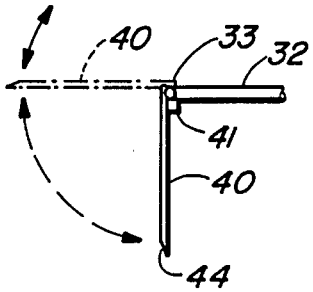
FIG. 6 is a side view of the guide ramp attached to a front portion of the top trough.

FIG. 5 illustrates the rectangular configuration of ramp 40 which also includes integral L-clips 41 and a series of edge slots 43 which allow for passage of the ramps past rods 35, when the ramp is pivoted downwardly for use or upwardly for storage, if desired. In FIG. 6, an interference fit between clip 41 and the fixed edge 33 of the upper trough is seen as well as the bevelled edge 44 of the ramp.

Figure 7:
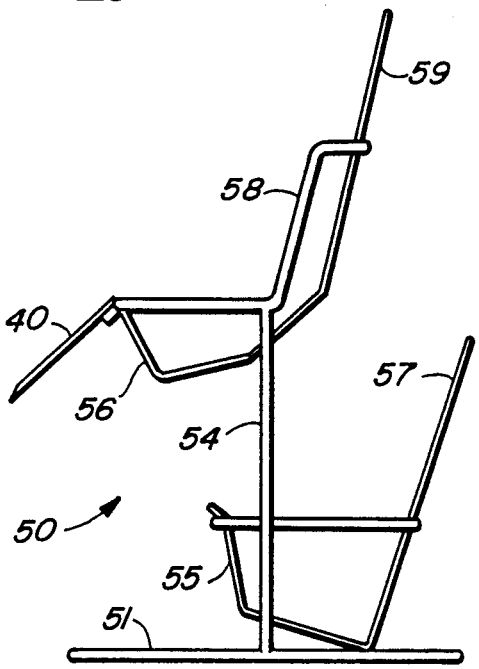
FIG. 7 is a side view of a second embodiment of the paper carrier.

FIG. 7 shows a second embodiment of the invention where the paper carrier 50 includes a rectangular base 51 which supports a pair of spaced vertical members 54 upstanding from the sides of the base. A lower paper unfolding trough 55 is welded to the members 54 with a majority of the trough rearward of members 54 while an upper paper refolding trough 56 has a majority of its construction extending forwardly of the members 54. As in FIGS. 1–4, paper stack supports 57, 59 extend upwardly from the rear of each respective trough. A bent arm 58 on each side of the upper trough prevents lateral movement of the refolded paper sheets.

Figure 8:
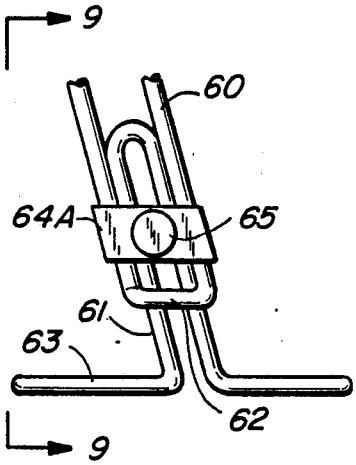
FIG. 8 is a schematic partial side view of an adjustable frame member taken on the line 8—8 of FIG. 9.
Figure 9:
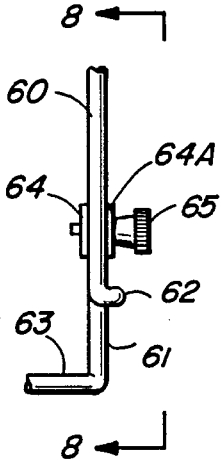
FIG. 9 is an edge view of the adjustable frame member of FIG. 8 taken on the line 9—9 thereof.

FIGS. 8 and 9 illustrate a rod frame adjustment feature which allows the carrier to be used and adjusted to a particular height of a printer or computer printer mechanism being employed. Frame members 14–17 of FIGS. 1–4 are modified so that each side frame is provided with a pair of telescoping portions 60, 61 which are movable with respect to one another. The lower loop portion 61 extends from a carrier base 63. The upper loop (U shaped) portion is movable upward or downward on portion 61 to adjust the height of the upper trough mounted on portion 60 in accord with the exit height of the printer mechanism. The lower end of portion 60 has a laterally offset U-shaped bottom 62 through which the exterior periphery of the portion 61 pass. Upon proper height adjustment a clamp, comprising a threaded aperture clamping plate 64 and a screw and knob 65 are tightened on clamp plate **64*a* so that plates 64 and 64*a* are clamped against the opposite sides of both portions 60, 61 to hold the portions in fixed vertical alignment. FIG. 9** shows this clamping action.

Figure 11:
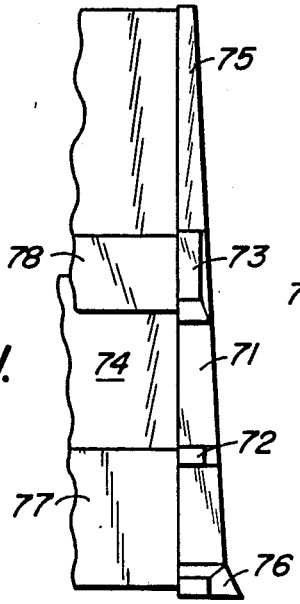
FIG. 11 is a partial front view of one side of the carrier of FIG. 10.
Figure 10:
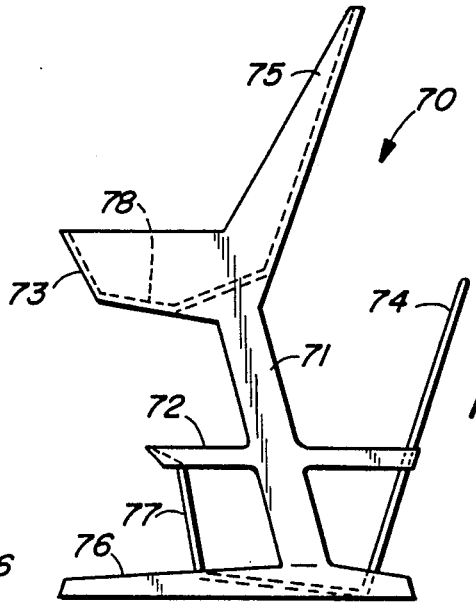
FIG. 10 is a side view of a third embodiment of the carrier.

FIG. 10 shows a carrier construction of a third embodiment in which a pair of plastic sheet members 70 provide the side frames of the carrier. Members 70 each comprise a vertical forward thrusting portion 71, integral lower and upper trough supporting side pieces 72, 73, respectively, an integral upper trough stack support side piece 75 and an integral carrier base side piece 76. A lower trough stack support 74 is attached to base 76 and the rear end of each side piece 72. As seen in FIG. 11, cross-pieces 77 and 78 also of plastic sheet material interconnect the pair of members 70 at the ends of side pieces 72, 73 and base 76 to form the lower and upper tiered paper-holding troughs. Cross pieces 77, 78 are bent or molded to form the front and bottom portions of the respective troughs corresponding to the contours of rod portions 25, 26 and 35, 36 of the FIGS. 1–4 embodiment.

The above description of embodiments of this invention is intend to be illustrative and not limiting. Other embodiments of this invention will be obvious to those skilled in the art in view of the above disclosure.

I claim:

1. A free-standing paper carrier for unfolding/refolding connected sheets of a continuous stack of Z-fold paper sheets comprising:

a first horizontal base for placement of said carrier on a horizontal work surface rearward of a printer housing resting on said surface;

a first pair of spaced integral upstanding outer frame members extending from opposite sides of said base rearward of a front portion of said base;

a first open lower trough connected across said outer frame members adjacent to and extending above said base including an upstanding paper stack support extending rearwardly from adjacent said base at an acute angle to said base; and a second open upper trough connected across a top portion of said outer frame members and extending forwardly of and spaced above said first trough, wherein a multiple folded stack of paper sheets is positionable at a rearward acute angle from the vertical in said first trough and forwardly feedable into an adjacent printing mechanism in said printer housing and wherein printed-on paper sheets of said stack exiting said printing mechanism are feedable to and automatically folded into said second trough.

2. The paper carrier of claim 1 in which said upper trough includes a horizontal front top edge positioned to extend above a paper exit portion of said printer housing and further including a guide ramp pivotable from said top edge to bridge between said top edge and said exit portion for guiding exiting printed-on paper sheets into said upper trough for refolding and storage.

3. The paper carrier of claim 2 in which said ramp includes a flat rectangular surface supporting exiting paper and permitting indicia to be manually written on said exiting paper by a user.

4. The paper carrier of claim 1 wherein said base and said outer frame members are constructed of bent rod stock and wherein said first trough is bent rod stock and includes a front horizontal rod stock portion over which said stack of sheets are passed when being fed from said first trough.

5. The paper carrier of claim 4 wherein said second trough is bent rod stock and includes a front horizontal top edge over which printed-on paper sheets exiting said printing mechanism are passed when being fed into said second trough.

6. The paper carrier of claim 1 wherein said second trough is bent rod stock and includes a front horizontal top edge over which printed-on paper sheets exiting said printing mechanism are passed when being fed into said second trough.

7. The paper carrier of claim 1 in which said first trough includes at least one pair of rod stock members having a bottom portion extending at a forward acute angle to said base for supporting bottom marginal edges of said multiple folded stack of paper sheets, and at least one upstanding rearward rod stock stack support extending upwardly at a rear of said first trough for supporting said stack of multiple folded paper sheets.

8. The paper carrier of claim 7 in which said second trough includes at lest one pair of rod stock members having a bottom portion extending at a rearward acute angle from a bottom of a front rod stock wall of said second trough; and at least one upstanding rearward rod stock stack support extending upwardly at a rear of said second trough for supporting said refolded sheets of said stack in said second trough.

9. The paper carrier of claim 8 further including a pair of L-shaped rod stock side bars extending along ends of said second trough and above a bottom of said upper trough for preventing lateral movement of a stack of refolded paper sheets therein.

10. The paper carrier of claim 9 in which the upstanding portions of said L-shaped side bars extend parallel to said at least one trough stack support of said second trough.

11. The paper carrier of claim 8 in which two spaced pairs of U-shaped stack supports extend upwardly and rearwardly to support a stack of folded paper sheets and refolded paper sheets, respectively in each of said first and second troughs.

12. The paper carrier of claim 1 wherein said first trough includes a series of forwardly extending cantilevered rod stock extensions for supporting paper sheets exiting said first trough.

13. The paper carrier of claim 1 wherein said first and second troughs and said outer frame members are constructed of plastic sheet material.

14. The paper carrier of claim 1 including means juxtaposed to said frame members for adjusting the height of said upper trough with respect to said lower trough.

15. The paper carrier of claim 14 in which said adjusting means comprises telescoping end loops on upper and lower portions of said frame members and a clamp for fixedly holding said upper and lower portions at various vertical positions thereof.

16. The paper carrier of claim 1 wherein said base front portion is slidable under a rear portion of said printer housing, said first lower trough extending rearwardly from said base front portion and said second upper trough having a forward portion extending over said rear portion of said printer housing.

17. A free-standing paper carrier for unfolding-/refolding connected sheets of a continuous stack of Z-fold paper sheets comprising:

a first horizontal base;

a first pair of spaced integral upstanding outer frame members extending from opposite sides of said base at an intermediate position of said base;

a first open lower trough connected across said outer frame members adjacent to said base including an upstanding paper stack support extending rearwardly from adjacent said base at an acute angle to said frame members;

a second open upper trough connected across a top portion of said outer frame members and extending forwardly of and spaced above said first trough, wherein a multiple folded stack of paper sheets is positionable in said first trough and feedable into an adjacent printing mechanism and wherein printed-on paper sheets of said stack exiting said printing mechanism are feedable to and automatically folded into said second trough;

said upper trough includes a horizontal front top edge positioned to extend above a paper exit portion of a printer/computer housing and further including a guide ramp pivotable from said top edge to bridge between said top edge and said exit portion for guiding exiting printed-on paper sheets into said upper trough for refolding and storage;

said ramp includes a flat rectangular surface supporting exiting paper and permitting indicia to be manually written on said exiting paper by a user; and wherein said ramp includes at least two mounting clips on a reverse side of said ramp for pivotably clamping said ramp on said upper trough front edge.

18. The paper carrier of claim 17 wherein said ramp includes a series of edge notches positioned to avoid interference of said ramp with front portions of said upper trough.

19. A free-standing paper carrier for unfolding-/refolding connected sheets of a continuous stack of Z-fold paper sheets comprising:

a first horizontal base;

a first pair of spaced integral upstanding outer frame members extending from opposite sides of said base at an intermediate position of said base;

a first open lower trough connected across said outer frame members adjacent to said base including an upstanding paper stack support extending rearwardly from adjacent said base at an acute angle to said frame members;

a second open upper trough connected across a top portion of said outer frame members and extending forwardly of and spaced above said first trough, wherein a multiple folded stack of paper sheets is positionable in said first trough and feedable into an adjacent printing mechanism and wherein printed-on paper sheets of said stack exiting said printing mechanism are feedable to and automatically folded into said second trough; and wherein said base includes a pair of oppositely-facing, horizontal rod stock U-shaped portions, a bent portion of a forward U-shaped base portion being slidable under a printer/computer housing and wherein said upstanding frame members are rod stock angularly extending forwardly and connected to said first and second troughs.

* * * * *